US007758154B2

(12) United States Patent
Yokozawa

(10) Patent No.: US 7,758,154 B2
(45) **Date of Patent: *Jul. 20, 2010**

(54) INKJET PRINTING APPARATUS AND INKJET PRINTING METHOD

(75) Inventor: Taku Yokozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

This patent is subject to a terminal disclaimer.

(21) Appl. No.: 11/003,450

(22) Filed: Dec. 6, 2004

(65) Prior Publication Data

US 2005/0128234 A1 Jun. 16, 2005

(30) Foreign Application Priority Data

Dec. 12, 2003 (JP) ..... 2003-415419

(51) Int. Cl.
*B41J 2/145* (2006.01)
*B41J 29/38* (2006.01)

(52) U.S. Cl. ..... 347/40; 347/9; 347/12

(58) Field of Classification Search ..... 347/9, 347/12, 14, 40, 43
See application file for complete search history.

(56) References Cited

U.S. PATENT DOCUMENTS 4,538,160 A 8/1985 Uchiyama
4,723,129 A 2/1988 Endo et al.
4,740,796 A 4/1988 Endo et al.
4,748,453 A 5/1988 Lin et al.
6,315,387 B1 11/2001 Horikoshi
7,083,255 B2 * 8/2006 Shibata et al. ..... 347/40
7,506,949 B2 * 3/2009 Shimoji ..... 347/15
2002/0167565 A1 * 11/2002 Maeda et al. ..... 347/40

FOREIGN PATENT DOCUMENTS

JP 58-128862 8/1983
JP 10-86353 4/1998
JP 2000-79681 3/2000
JP 2001-171151 6/2001

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

In an inkjet printing apparatus comprising a printhead having a plurality of nozzle arrays, where a plurality of nozzles for one ink are arranged in a predetermined direction, for performing printing by moving the printhead relatively to a printing medium in a direction crossing to the predetermined direction, the plurality of nozzle arrays are controlled so that a printing duty of preceding nozzle arrays in the relative movement is higher than a printing duty of subsequent nozzle arrays. By virtue of this control, it is possible to suppress generation of color mixture and bleeding, and achieve high-speed printing with high image quality.

12 Claims, 9 Drawing Sheets

INKJET PRINTING APPARATUS AND INKJET PRINTING METHOD

FIELD OF THE INVENTION

The present invention relates to an ink-jet printing-apparatus and an inkjet printing method, and more particularly, to an inkjet printing apparatus and an inkjet printing method, which realizes printing by comprising a plurality of printing element arrays, where plural printing elements for one ink are arranged in a predetermined direction, and by moving the plurality of printing element arrays relatively to a printing medium in a direction crossing to the printing element arrangement direction.

BACKGROUND OF THE INVENTION

Along with widespread use of data processing devices such as copying machines, word processors, computers and so on as well as communication devices, printing apparatuses for these devices that can perform digital image printing with a printhead employing an inkjet printing method are rapidly prevailing. To improve printing speed, these printing apparatuses generally use, for a printing element array where plural printing elements are integrally arranged, a printhead integrally comprising plural ink discharge orifices (nozzles) and plural liquid paths. To perform color printing, these printing apparatuses generally use a printhead comprising plural printing element arrays.

Unlike a monochrome printer which prints texts only, it is necessary for a color printer which prints color images to improve various features, e.g., coloring characteristics, tonality, uniformity and so on, for improved printing image quality. Particularly with respect to uniformity, slight unevenness in nozzle unit which is caused in the printing element array manufacturing process influences the ink discharge amount and discharge direction of each nozzle when printing is performed, ultimately generating unevenness in density of a printed image and causing deterioration in image quality.

In order to reduce such density unevenness, as disclosed in U.S. Pat. No. 4,748,453 (Patent Document 1), a so-called multi-pass printing method has already been proposed. In the multi-pass printing method, pixels of an area that can be printed in one scan are divided into plural groups, and printing of this area is completed by multiple times of scanning. By performing multi-pass printing, the pixels of an area that can be printed in one scan are printed by utilizing different nozzles for each scan. Therefore, the influence inherent to each nozzle which is imposed on the printed image is reduced, and density unevenness in the printed image can be reduced considerably.

However, in a case where the above-described multi-pass printing is performed, a priority color differs depending on the sequence of ink discharged to the printing medium. As a result, one color may be recognized as different colors because of the characteristics of human visual perception.

For instance, assume a case where printing elements provided for respective colors are arranged in order of black, cyan, magenta, and yellow from the right, and scanning is performed by reciprocally moving the printhead in the head arrangement direction (left-and-right direction) (forward scan is the right direction and backward scan is the left direction).

The sequence of printing on a piece of paper corresponds to the aforementioned arrangement order of the printing elements. Therefore, for instance, in a case of printing green (cyan+yellow) pixels of a predetermined area in forward scan, ink is absorbed at the printing position of each pixel on the printing medium in order of cyan and yellow. Therefore, in forward scan, cyan which is absorbed first becomes the priority color, forming a green dot having strong cyan color. Meanwhile, in backward scan, printing is performed while moving the printhead in a direction opposite to the forward scan. Therefore, the sequence of ink discharge is reversed. In backward scan, a green dot having strong yellow color is obtained.

As a result of repeating the above-described scan, green dots having strong cyan color and green dots having strong yellow color are printed depending on whether the green dots are printed in forward scan or backward scan. If the printing medium is conveyed for a distance corresponding to a printing width of the printhead for each of the forward scan and backward scan, the green area having strong cyan color and the green area having strong yellow color are alternately printed for the width of the printhead. As a result, the green area that is supposed to be uniform is considerably deteriorated.

In order to prevent such color unevenness caused by the different ink discharge sequence in the forward scan and backward scan, printing has to be performed by either the forward scan only or the backward scan only. However, the current trend demands for higher speed and higher quality in printing. In such multi-pass printing which realizes printing of respective printing areas in multiple times simply by either the forward scan only or the backward scan only, the time cost required in printing becomes more than doubled. This is not a preferable situation in a printing apparatus.

In view of this, an inkjet printing apparatus disclosed in Japanese Patent Application Laid-Open No. 2001-171151 or No. 2000-079681 is known. In this inkjet printing apparatus, two printing element arrays are provided for each color of ink and arranged symmetrically so that the ink discharge sequence is the same in forward scan and backward scan.

According to this apparatus, color unevenness caused by the different ink discharge sequence in the forward scan and backward scan will not be generated. Furthermore, by utilizing the two printing element arrays provided for each color of ink, it is possible to reduce the number of times of scanning in multi-pass printing and further improve the printing speed.

However, if the number of times of scanning in multi-pass printing is reduced and high-speed printing is performed by the inkjet printing apparatus having two symmetrically arranged printing element arrays for each color of ink, the printing duty per unit time is doubled, resulting a situation where a large amount of ink droplets is discharged before ink is sufficiently fixed to the printing medium.

If a large amount of ink droplets is discharged to a printing medium in a relatively short period of time, the boundary portions of adjacent ink dots join together, causing color mixture between different colors, or bleeding occurs causing blur in texts and ruled lines. Therefore, image quality declines considerably.

By contrast, Japanese Patent Application Laid-Open No. 10-086353 discloses an inkjet printing method which improves ink fixability to a printing medium by providing heaters underneath the platen that is facing the printhead so as to dry the printing medium and ink with the radiation heat. However, an inkjet printing apparatus employing such printing method is compelled to increase its cost largely. Furthermore, the effect of the printing method decreases as the printing speed increases.

Furthermore, Japanese Patent Application Laid-Open No. 58-128862 discloses an inkjet printing method which identifies an image position to be printed in advance and performs printing by overlapping the printing ink with processing liquid for improving printability which contains a component for insolubilizing or coagulating the component in the printing ink. This inkjet printing method improves ink fixability to a printing medium by discharging the processing liquid prior to the printing ink, or discharging the processing liquid on top of the previously discharged printing ink, or discharging printing ink on top of the previously discharged processing liquid and further discharging the processing liquid on top. However, in this method, it is necessary to separately provide a printhead for the processing liquid in addition to the printhead for conventional printing ink. This causes an increased cost and an enlarged apparatus.

SUMMARY OF THE INVENTION

The present invention can provide an inkjet printing apparatus that does not cause an increased cost or an enlarged apparatus, which is capable of printing with excellent printing quality with less color mixture and bleeding, even in a case of performing high-speed printing with a reduced number of times of scanning in multi-pass printing so as not to cause color unevenness.

The present invention can also provide an inkjet printing method which can perform printing with excellent printing quality with less color mixture and bleeding even in a case of performing high-speed printing with a reduced number of times of scanning in multi-pass printing so as not to cause color unevenness.

According to one aspect, the present invention can be attained by an inkjet printing apparatus having a plurality of printing element arrays where a plurality of printing elements for one ink are arranged in a predetermined direction, for performing printing by moving the plurality of printing element arrays relatively to a printing medium in a direction crossing the predetermined direction, comprising: printing duty control means which controls the plurality of printing element arrays in a way that a printing duty of preceding printing element arrays in the relative movement is higher than a printing duty of subsequent printing element arrays.

In this configuration, among the plurality of printing element arrays provided for one ink, it is controlled so that the printing duty of the preceding printing element arrays in the moving direction is higher than the printing duty of the subsequent printing element arrays. Therefore, the ink from the preceding printing element arrays is discharged after the time elapses for the ink discharged in the previous relative movement to permeate the printing medium to a certain degree. Therefore, the ink from the preceding printing element arrays is controlled in a way that a relatively large amount of ink is discharged. Meanwhile, the ink from the subsequent printing element arrays is discharged before the time elapses for the ink discharged from the preceding printing element arrays to permeate the printing medium. Therefore, the ink from the subsequent printing element arrays is controlled in a way that a relatively small amount of ink is discharged.

Accordingly, it is possible to suppress generation of color mixture in boundary portions of adjacent ink dots, which is caused by ink discharged from the preceding printing element arrays and ink discharged from subsequent printing element arrays joined together on the printing medium surface, and suppress generation of bleeding that causes blur in texts and ruled lines, and it is possible to achieve high-speed printing while maintaining the image quality level.

The inkjet printing apparatus may comprise a carriage incorporating the plurality of printing element arrays, and scanning means which reciprocally scans the carriage over the printing medium, wherein the printing duty control means switches the printing element arrays of a higher printing duty in a forward scan and a backward scan.

Preferably, the inkjet printing apparatus further comprises two printheads provided along the moving direction, the printhead employing plural types of ink for the ink and comprising one printing element array for each ink, wherein the arrangement of the printing element arrays of the two printheads is symmetrical with respect to the center of the two printheads.

The printing duty control means may employ mask patterns, having different mask rates for the plurality of printing element arrays, to control in a way that the printing duty of preceding printing element arrays in the relative movement is higher than the printing duty of subsequent printing element arrays.

The printing duty control means may divide each of the plurality of printing element arrays into a plurality of blocks, and control the blocks so that the number of blocks driven in preceding printing element arrays in the relative movement is larger than the number of blocks driven in subsequent printing element arrays.

The multi-pass printing in which printing of each printing area may be completed by repeating the relative movement plural numbers of times is performed.

Each printing element may comprise a heat energy transducer, which generates heat energy to be applied to ink, for discharging ink by utilizing the heat energy.

Furthermore, the present invention can be attained by an inkjet printing method corresponding to the above-described inkjet printing apparatus, a computer program which realizes the inkjet printing method by using a computer, and a computer-readable storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that each of constitution elements described in the following embodiments is only an example, and is not intended to limit the scope of the present invention thereto.

In each of the following embodiments, a printing apparatus employing a printhead according to the ink-jet system is described as an example.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "nozzle" should be interpreted as any combination of a discharge opening, a channel communicating thereto and an energy-generating element used for discharging ink, without annotation.

First, a construction of an inkjet printing apparatus which is common to the following embodiments is described with reference to FIGS. 1 and 2.

Figure 1:
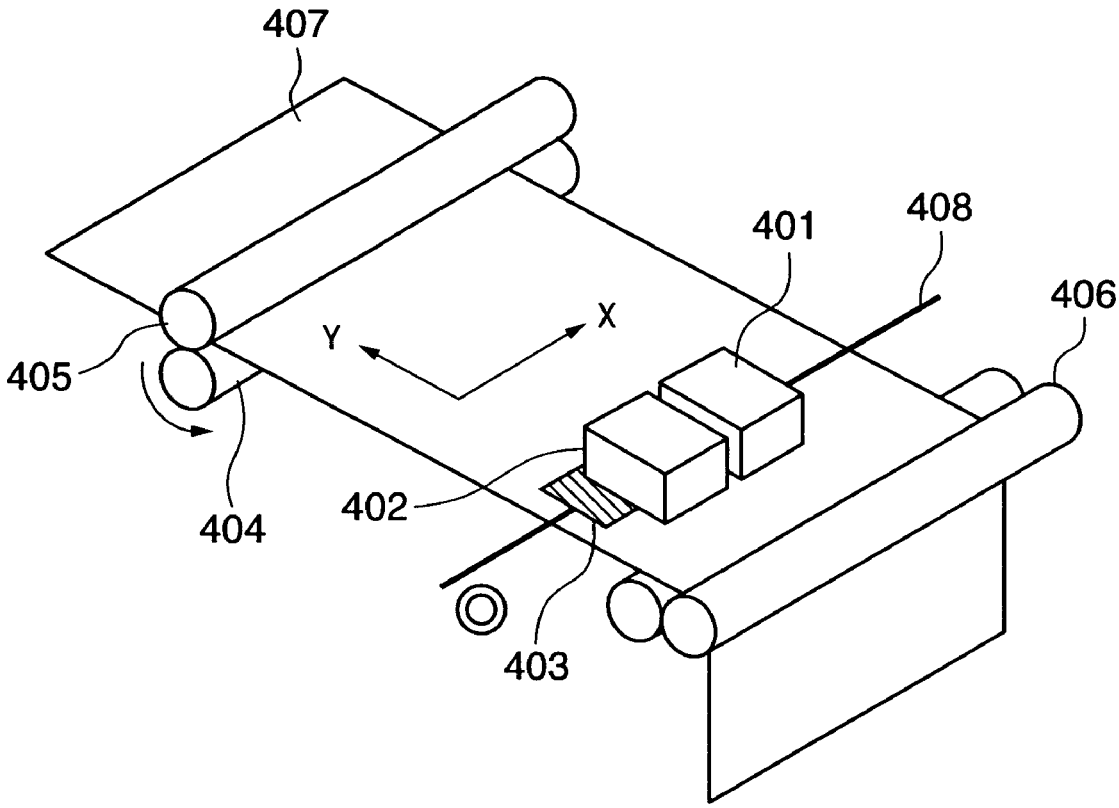
FIG. 1 is a perspective view showing a brief configuration related to printing for explaining an embodiment of an inkjet printing apparatus according to the present invention.

FIG. 1 is a perspective view showing a brief construction of a printing unit of an inkjet printing apparatus according to the present invention. FIG. 2 is a view showing an arrangement of the printing element arrays of the printheads, which are seen from the discharge-surface side.

As shown in FIG. 1, the inkjet printing apparatus according to the present invention comprises a first printhead 401 and a second printhead 402 on a carriage 403 which is movable in X direction along a guide rail 408. The first printhead 401 and the second printhead 402 respectively comprise ink tanks for supplying four color inks including black (Bk), cyan (Cy), magenta (Mg), and yellow (Ye). Each of the printheads is configured as a multi-printhead integrally comprising four arrays of printing elements corresponding to the respective ink tanks. The two printheads are mounted to the carriage 403 in a way that the first printhead 401 is at the forefront in the carriage moving direction (X direction).

Figure 2:
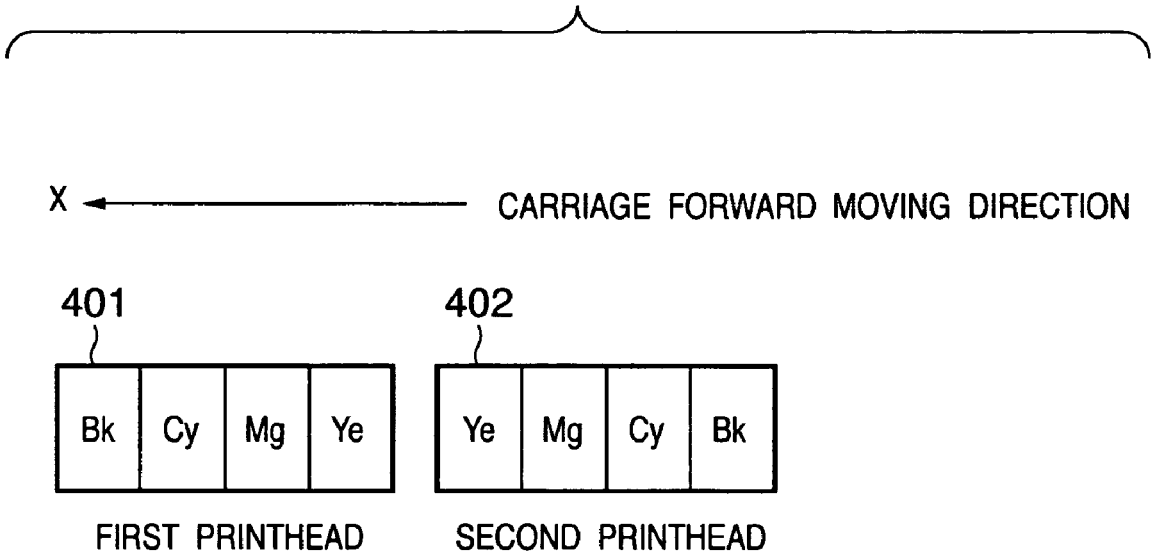
FIG. 2 is a view of the first and second printheads shown in FIG. 1, which is seen from the discharge-surface side.

If the arrangement of the printing element arrays of the first printhead 401 and the second printhead 402 is seen from the discharge surface side, as shown in FIG. 2, the printing element arrays of the first printhead 401 are arranged in order of Bk, Cy, Mg, and Ye from the forefront of the carriage moving direction, while the printing element arrays of the second printhead 402 are arranged in order of Ye, Mg, Cy, and Bk in a way that they are symmetrical to the arrangement of the printing element arrays of the first printhead.

The carriage 403 exists at the home position indicated by the mark ◎ in FIG. 1 on stand-by state, e.g., non-printing state. Numeral 404 denotes a sheet-advancing roller, which rotates in the direction of the arrow in FIG. 1 while tightly holding a printing medium 407 along with an auxiliary roller 405, and conveys the printing medium 407 in Y direction. Numeral 406 denotes a sheet-feeding roller, which feeds the printing medium 407 from a tray (not shown) where the printing medium is stacked, and also serves to tightly hold the printing medium 407 along with the sheet-advancing roller 404 and the auxiliary roller 405.

The basic reciprocal printing operation in the above-described configuration is now described. The carriage 403, which exists at the home position ◎ on stand-by state, starts scanning in X direction upon reception of a print-start command. A plurality of nozzles of the first printhead 401 and the second printhead 402 are selectively driven in accordance with printing data, and printing is performed by discharging ink to the printing medium 407. When the printing performed by one time of scanning is completed to the end of the printing medium 407, the carriage 403 returns to the home position ◎. Then, the sheet-advancing roller 404 rotates in the direction of the arrow, thereby conveying the printing medium in Y direction for a predetermined distance, thereafter printing is started again by scanning in X direction. By repeating the print-scanning and printing-medium conveyance alternately, printing on a sheet of printing medium is performed.

Next, the control structure of the above-described inkjet printhead is described with reference to FIG. 9.

Figure 9:
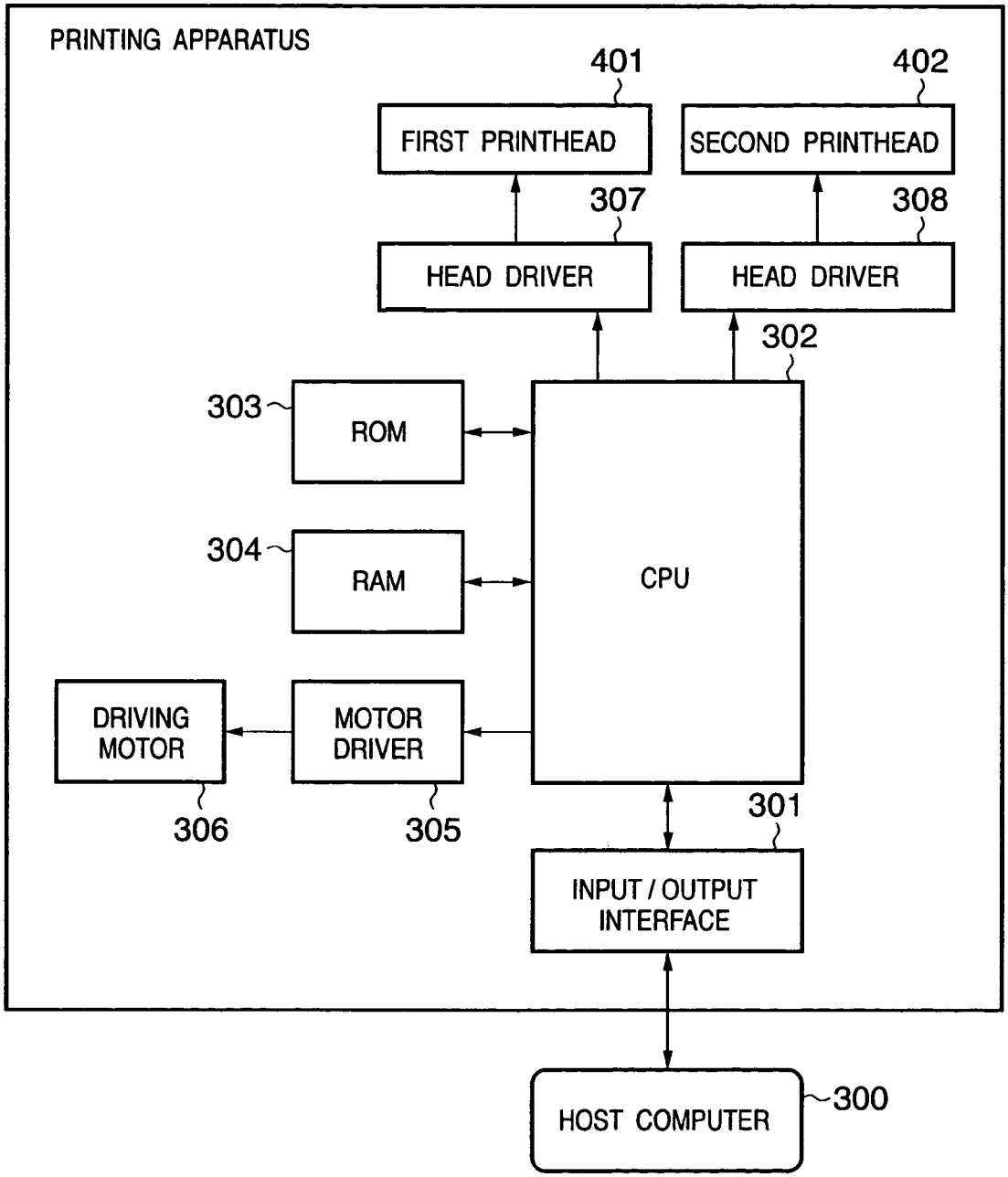
FIG. 9 is a block diagram showing a control structure of the printing apparatus shown in FIG. 1.

Numeral 300 in FIG. 9 denotes a host computer which transmits to the printing apparatus image data to be printed and control data, e.g., a printing command, and receives status data or the like from the printing apparatus. Numeral 301 denotes an input/output interface which receives control data and image data transmitted from the host computer, and outputs status data or the like to the host computer. Numeral 302 denotes a CPU which controls the entire apparatus. Numeral 303 denotes ROM which stores a control program and data such as fonts. Numeral 304 denotes RAM which serves as a printing buffer for temporarily storing printing data and serves as a work area of the CPU. Numeral 305 denotes a motor driver which drives various driving motors 306 for a sheet-feeding roller or the like, and drives the conveyance roller and causes movement of the carriage. Numerals 307 and 308 denote head drivers which respectively drive the first printhead 401 and the second printhead 402.

Image data transmitted from the host computer 300 is temporarily stored in a reception buffer of the input/output interface 301, then converted to printing data processable by the printing apparatus, and supplied to the CPU 302. Based on a control program stored in the ROM 303, the CPU 302 divides the printing data, supplied to the CPU 302, in units of ink and temporarily stores the data in a printing buffer of the RAM 304. The printing data stored in the printing buffer of the RAM 304 is read out by the CPU 302 in accordance with the driving sequence of the printing element arrays of each ink, and outputted to the head drivers 307 and 308 in accordance with the actual discharge timing. The corresponding printhead is driven to discharge ink, thereby performing printing.

First Embodiment

The first embodiment employing the above-described printing apparatus and adopting the present invention is described in detail. The first embodiment is constructed such that printing operation of the first printhead 401 and the second printhead 402 is controlled by thinning processing using mask patterns.

An inkjet printing apparatus according to the first embodiment not only performs printing by distributing printing dots to the first printhead 401 and the second printhead 402 and executing reciprocal scanning (bi-directional printing), but also employs a multi-pass printing method where an image is formed by scanning one area multiple times. As mentioned above, multi-pass printing is a printing method which forms an image by using plural nozzles in one line, thus reduces density unevenness caused by a slight difference in the ink discharge amount or the ink discharge direction of each nozzle.

Among multi-pass printing methods, the first embodiment implements a multi-pass printing method which adopts random mask thinning in combination with data thinning. In random mask thinning, printing data for each pass (hereinafter referred to as pass data) is generated by thinning the data at random for eliminating the regularity of nozzles used for each pass. In data thinning, printing data for each pass is generated by regularly thinning printing dots. In the first embodiment, assume that the number of printing passes is two, and that the first printhead 401 and the second printhead 402 respectively have 1280 nozzles arranged substantially along the printing medium conveyance direction with respect to each of the four colors Bk, Cy, Mg, and Ye.

Figure 3:
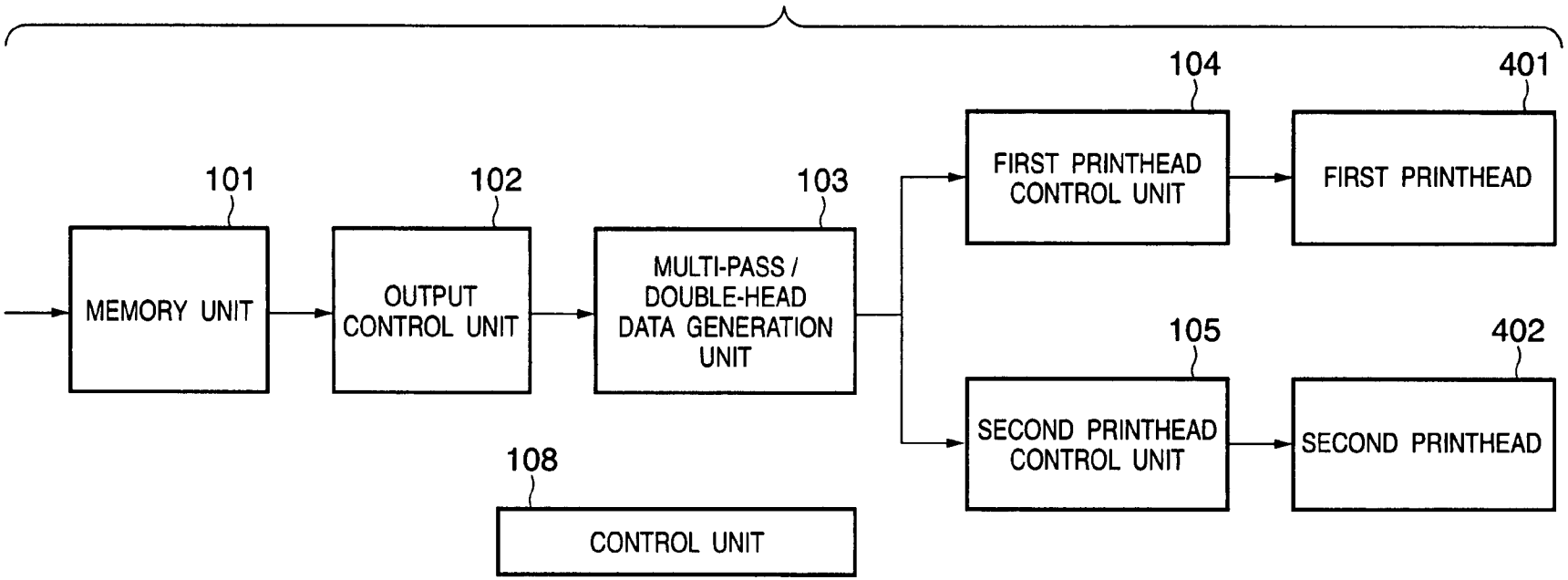
FIG. 3 is a function block diagram showing a construction of control blocks according to the first embodiment.

FIG. 3 is a function block diagram showing a data flow related to printhead control according to the first embodiment of the present invention.

Numeral 101 denotes a memory unit which temporarily stores printing data on which image processing has been performed in accordance with the type of ink used by the printhead. The memory 101 also stores 2-bit data indicative of the number of printing passes of the printhead. Numeral 102 denotes a memory output control unit which performs printing data reading processing based on a relative position of each printing element array of the printhead with respect to the printing medium. Numeral 103 denotes a multi-pass/double-head data generation unit which generates pass data for the first printhead and pass data for the second printhead by thinning the printing dots in accordance with the number of printing passes.

Numeral 104 denotes a first printhead control unit which generates various control signals for driving the first printhead 401. Numeral 105 denotes a second printhead control unit which generates various control signals for driving the second printhead 402. Numeral 108 denotes a control unit which monitors the state of each unit and performs various controls related to printhead driving.

The correspondence between each function block shown in FIG. 3 and control structure shown in FIG. 9 is described. The memory unit 101 corresponds to the ROM 303 and RAM 304; the output control unit 102, the multi-pass/double-head data generation unit 103, and the control unit 108 correspond to the CPU 302 (and an encoder which is not shown); the first printhead control unit 104 and the second printhead control unit 105 correspond to the head drivers 307 and 308 respectively.

The overall basic data flow regarding printhead control is described. In the memory unit 101, printing data binarized by binarization means (not shown) is temporarily stored in units of ink to be used. Based on the printing area control data transmitted from the control unit 108, the output control unit 102 reads the binary printing data, stored in the memory unit 101 in units of scan, in accordance with the relative position of the printing element array corresponding to each ink, and outputs it to the multi-pass/double-head data generation unit 103. The multi-pass/double-head data generation unit 103 generates first printhead pass data for the first printhead 401 and second printhead pass data for the second printhead 402 by utilizing the random mask thinning in combination with data thinning in accordance with the number of printing passes, and outputs the pass data respectively to the first printhead control unit 104 and the second printhead control unit 105.

Next, the generation method of each printhead pass data is described in detail.

Figure 4A:
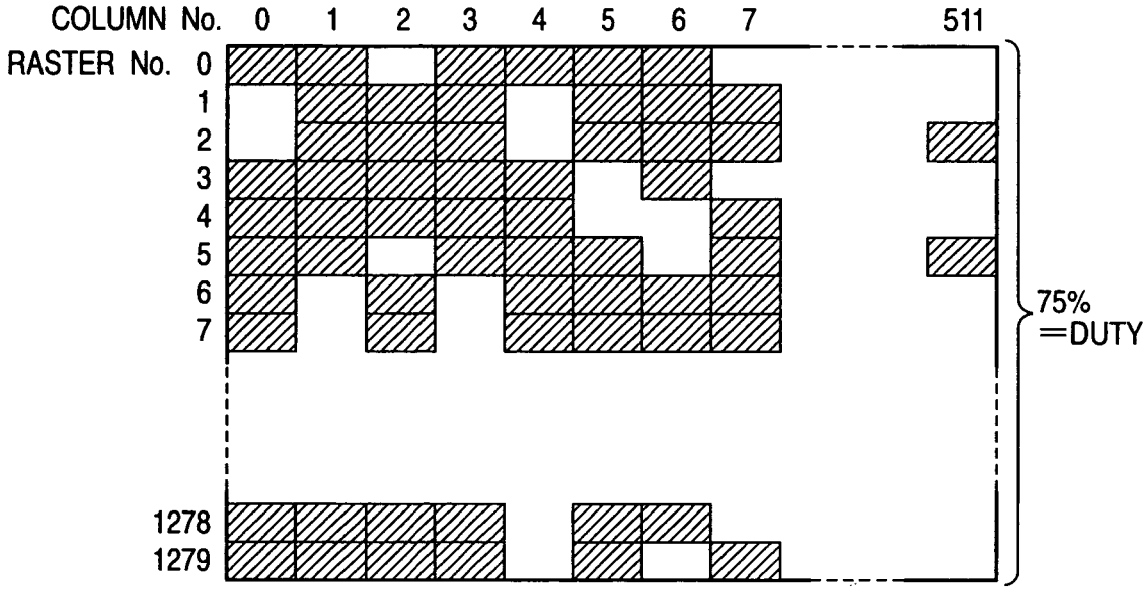
FIGS. 4A and 4B are pattern diagrams showing an example of random mask patterns employed in the first embodiment.
Figure 4B:
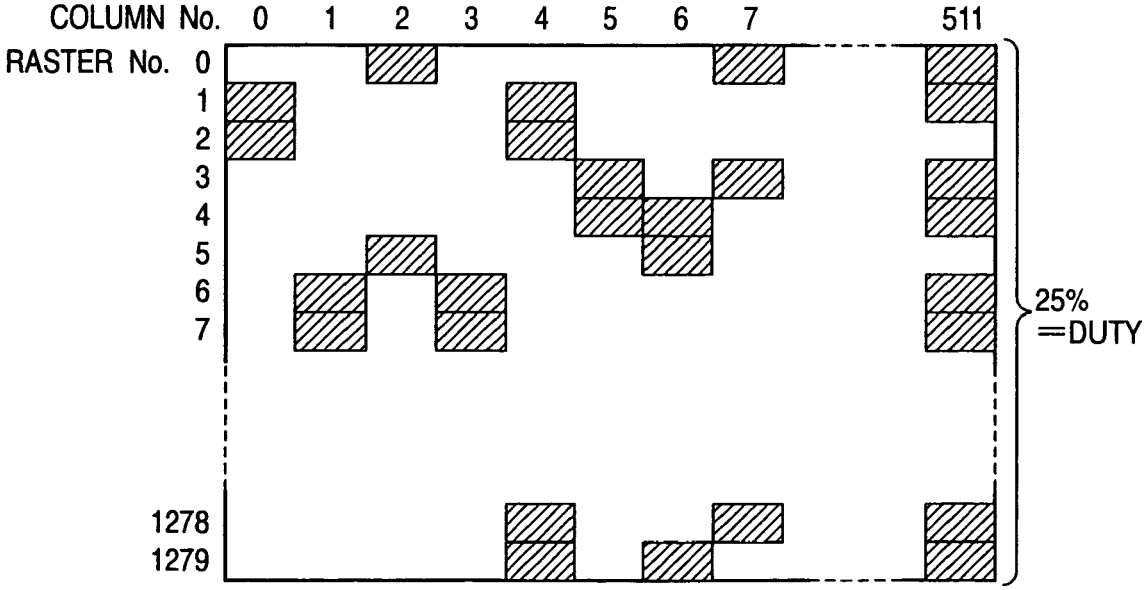
Figure 5A:
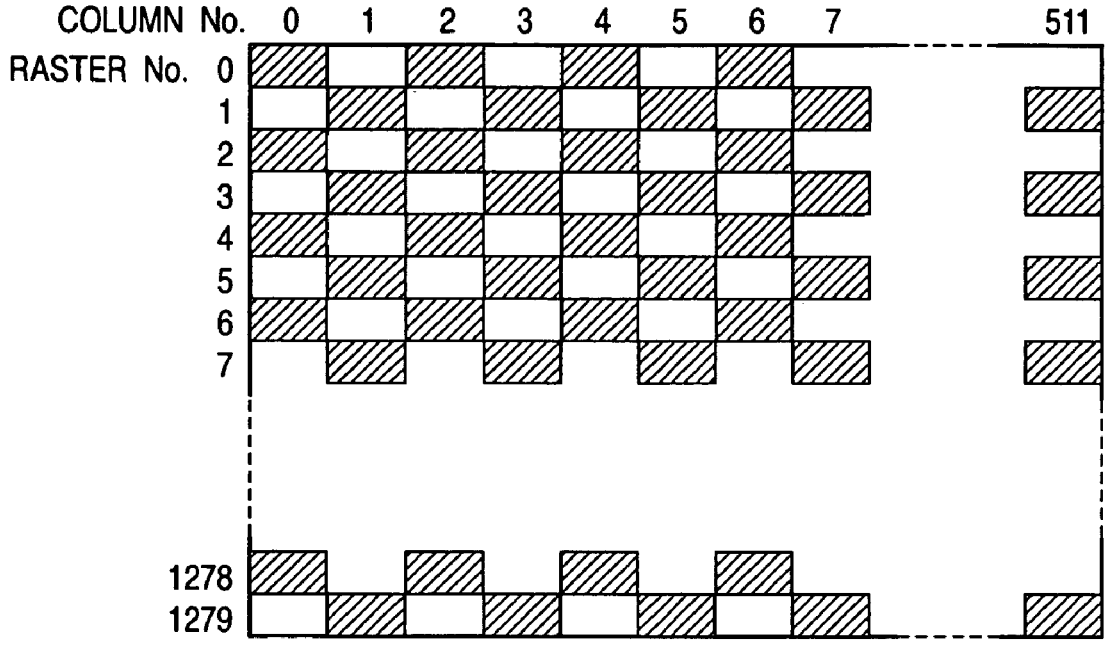
FIGS. 5A and 5B are pattern diagrams showing an example of thinning patterns employed in the first embodiment.
Figure 5B:
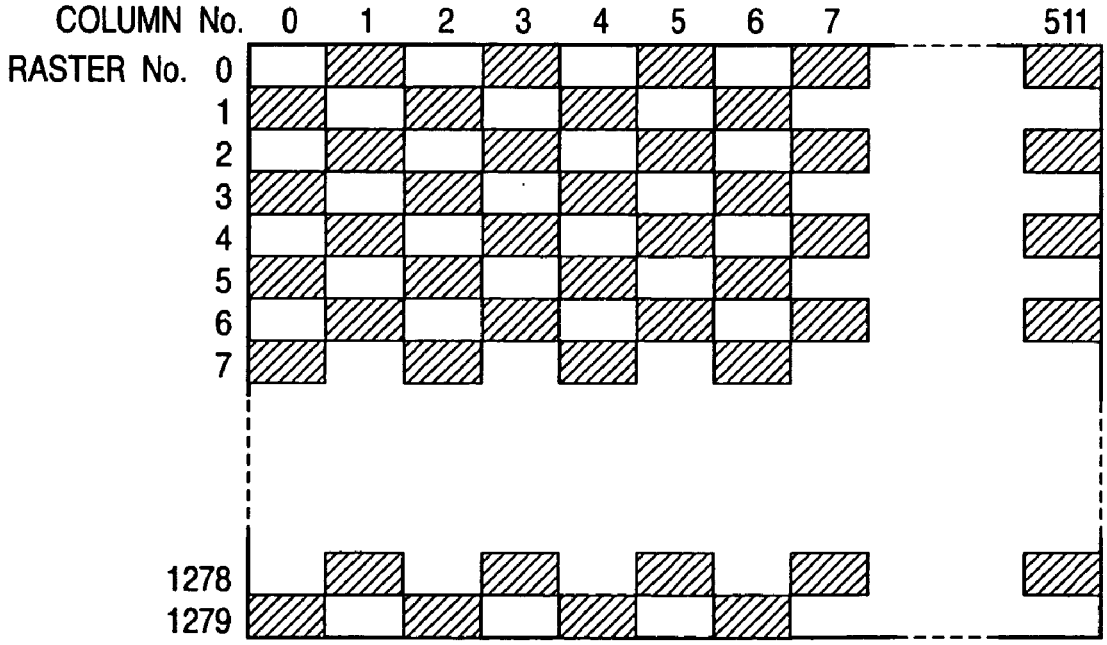

FIGS. 4A and 4B show an example of mask patterns used in the first embodiment. FIG. 4A shows a random mask pattern of 75% printable duty (25% thinning rate), hereinafter, referred to as a random mask pattern A. FIG. 4B shows a random mask pattern of 25% printable duty (75% thinning rate), hereinafter, referred to as a random mask pattern B. This random mask pattern B has an arrangement of printing and non-printing areas reversed from the pattern of FIG. 4A so that the pattern in FIG. 4B is complementary to the pattern in FIG. 4A. FIGS. 5A and 5B show an example of data thinning patterns used in accordance with the printhead in the first embodiment. FIG. 5A shows a checkered thinning pattern of 50% thinning rate for the first printhead (hereinafter referred to as a thinning pattern 1). FIG. 5B shows a reversed checkered thinning pattern of 50% thinning rate for the second printhead (hereinafter referred to as a thinning pattern 2) where printing and non-printing areas are reversed from the pattern of FIG. 5A so that the pattern in FIG. 5B is complementary to the pattern in FIG. 5A.

As these random mask patterns and thinning patterns, the first embodiment presents a pattern having print density of 1200 dpi and having a printing area for 655,360 pixels, including 1280 pixels in the raster direction and 512 pixels in the column direction. Note in the patterns shown in FIGS. 4A, 4B, 5A and 5B, pixels in the black portions are printed but pixels in the white portions are not printed.

Herein, a description is provided on a method of generating pass data, used in each scan of two-pass reciprocal printing, by utilizing these patterns. With respect to the first printhead, to generate pass data for the forward scan based on a result of performing data thinning on the printing data using the thinning pattern 1, the random mask pattern A is used to perform thinning. To generate pass data for the backward scan, the random mask pattern B is used to perform thinning. Meanwhile, with respect to the second printhead, to generate pass data for the forward scan based on a result of performing data thinning on the printing data using the thinning pattern 2, the random mask pattern B is used to perform thinning. To generate pass data for the backward scan, the random mask pattern A is used to perform thinning.

In other words, pass data for the respective printheads in respective scans in the forward direction and backward direction is obtained by performing the following processing on the printing data:

forward direction: first printhead: thinning pattern 1×random mask pattern A forward direction: second printhead: thinning pattern 2×random mask pattern B backward direction: first printhead: thinning pattern 1×random mask pattern B backward direction: second printhead: thinning pattern 2×random mask pattern A Note that the sign x indicates a logical product.

As described above, in the first embodiment, all pixels corresponding to the data to be printed in each printing area are distributed in a way that the preceding printhead in each scan (i.e., first printhead in the forward direction, and second printhead in the backward direction) prints a larger number of pixels than the subsequent printhead in each of the reciprocal two-time scans.

Figure 6:
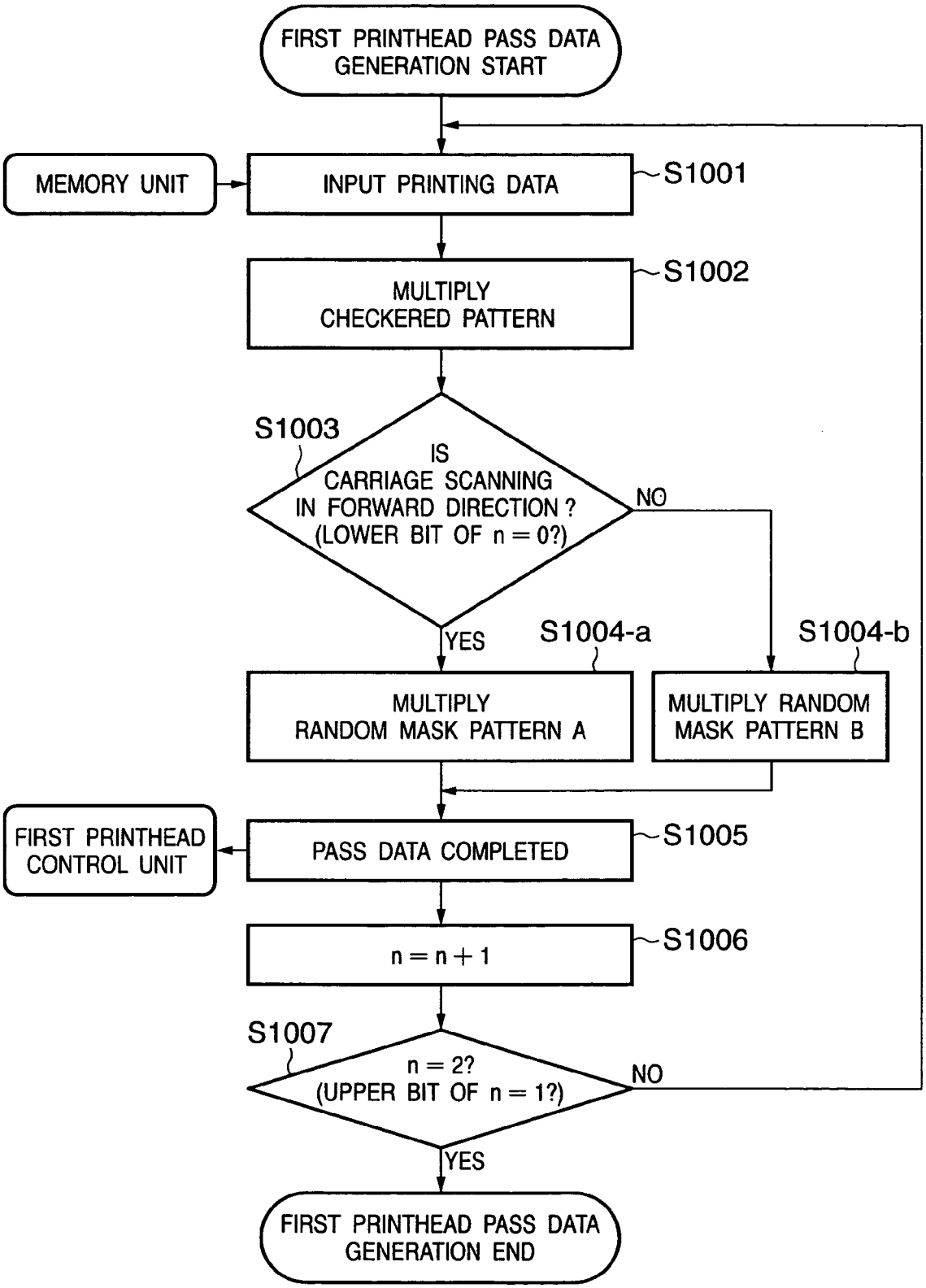
FIG. 6 is a flowchart describing a pass data generation procedure for the first printhead in reciprocal two-pass printing according to the first embodiment.

FIG. 6 is a flowchart describing a pass data generation procedure for the first printhead performed by the multi-pass/double-head data generation unit according to the first embodiment. When printing data is inputted from the memory unit 101 (step S1001), the printing data is multiplied by the thinning pattern 1 in FIG. 5A to obtain a logical product (step S1002). Next, a two-bit scanning-number-of-times variable n stored in the memory unit 101 is read, and the scanning direction of the printhead is determined based on whether or not the lower bit is 0 (step S1003).

In step S1003, in a case where the lower bit of variable n is 0, the scanning direction is a forward direction. Therefore, the data obtained in step S1002 is multiplied by the random mask pattern A to obtain a logical product (step S1004-*a*). In a case where the lower bit of variable n is not 0, i.e., n is 1, the scanning direction is a backward direction. Therefore, the data obtained in step S1002 is multiplied by the random mask pattern B to obtain a logical product (step S1004-*b*).

In this stage, the pass data generation ends, and pass data to be printed in respective scanning directions by the first printhead is obtained (step S1005). The pass data is outputted to the first printhead control-unit, which transfers the data to the printhead at appropriate timing for printing. Finally, the scanning-number-of-times variable n is incremented by 1 (step S1006). Then, it is determined whether or not the value of the variable n becomes 2 (step S1007). If the value is 2 (the upper bit of n is 1), the control ends as the pass data generation for both forward and backward directions of the first printhead is completed. If the value is less than 2 (the upper bit of n is 0), the control returns to step S1002 to repeat the printing data generation processing again.

Figure 7:
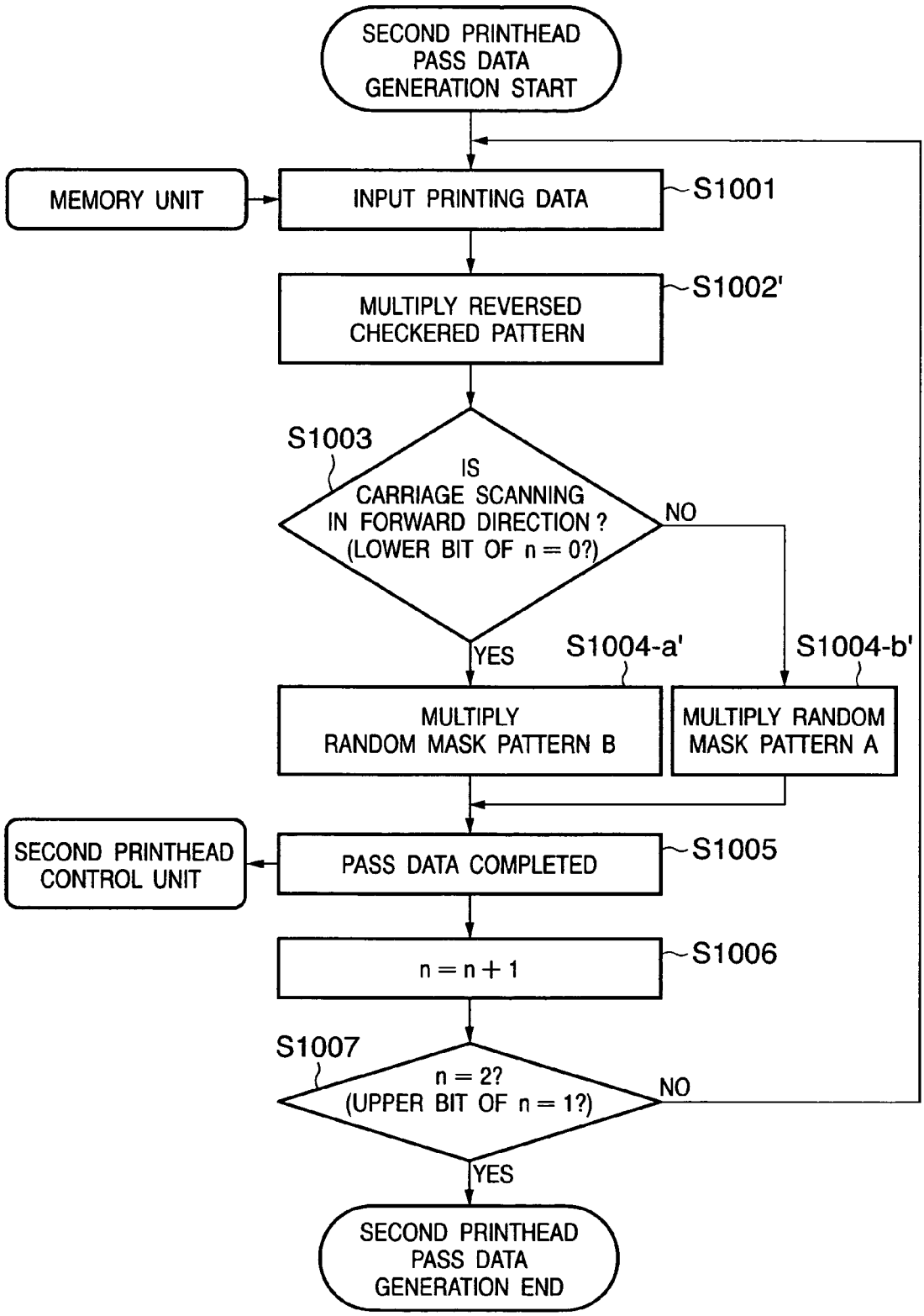
FIG. 7 is a flowchart describing a pass data generation procedure for the second printhead in reciprocal two-pass printing according to the first embodiment.

FIG. 7 is a flowchart describing, as similar to FIG. 6, a pass data generation procedure for the second printhead performed by the multi-pass/double-head data generation unit according to the first embodiment.

The differences between the pass data generation procedure for the first printhead shown in FIG. 6 and the procedure shown in FIG. 7 are described below. The thinning pattern 1 is used for the first printhead in step S1002, whereas the thinning pattern 2 is used for the second printhead (step S1002'). The random mask pattern A is used in the forward scan (step S1004-*a*) and the random mask pattern B is used in the backward scan (step S1004-*b*) for the first printhead, whereas the random mask pattern B is used in the forward scan (step S1004-*a*') and the random mask pattern A is used in the backward scan (step S1004-*b*') for the second printhead.

As described above, in a case where two-pass reciprocal printing is performed by the first embodiment, in forward scan the first printhead 401 positioned at the forefront of the scanning direction precedes the printing operation, while in backward scan the second printhead 402 positioned at the forefront of the scanning direction precedes the printing operation. In the forward scan, the thinning pattern 1 and the random mask pattern A are used in the pass data generation for the preceding first printhead 401, while the thinning pattern 2 and the random mask pattern B are used in the pass data generation for the subsequent second printhead 402. Meanwhile, in the backward scan, the thinning pattern 2 and the random mask pattern A are used in the pass data generation for the preceding second printhead 402, while the thinning pattern 1 and the random mask pattern B are used in the pass data generation for the subsequent first printhead 401.

As a result, when a uniform image is printed, the pass data for (printing element arrays of) the preceding printhead in the scanning direction has three times as large the amount as the pass data of the subsequent printhead.

This configuration increases the ratio (printing duty) at which ink is discharged by the preceding printhead in the scanning direction which secures a certain level of elapsed time since the ink discharge of the previous scan, and decreases the ratio (printing duty) at which ink is discharged by the subsequent printhead which cannot sufficiently secure the elapsed time since the ink discharge of the preceding printhead. As a result, it is possible to reduce generation of color mixture and bleeding.

Note that the first embodiment has described an example of generating pass data by utilizing a set of two random mask patterns A and B having the printing duty ratio of 75% to 25% as shown in FIGS. 4A and 4B. However, other set of random mask patterns may be used as long as the set of patterns has a larger printing duty for the preceding printhead than a printing duty of the subsequent printhead and a total of these printing duties become 100%.

Similarly, with respect to the thinning patterns, as long as the set of patterns is complementary to each other, other set of patterns may be used besides the set of checkered pattern and reversed checkered pattern shown in FIGS. 5A and 5B.

Second Embodiment

Hereinafter, the second embodiment according to the present invention is described. In the following descriptions, with respect to the portions similar to that of the first embodiment, descriptions thereof are omitted, and a characteristic portion of the second embodiment is mainly described.

In the first embodiment, mask patterns are used for generating pass data which is the driving data of each nozzle. In the second embodiment, nozzles of the respective printing element arrays are divided into plural blocks, then a block to be used in each scan of the reciprocal scans is selected, and nozzles to be driven are selected.

The printing apparatus according to the second embodiment has a similar construction as that of the first embodiment. However, the number of nozzles which constitute each printing element array is different.

Figure 8:
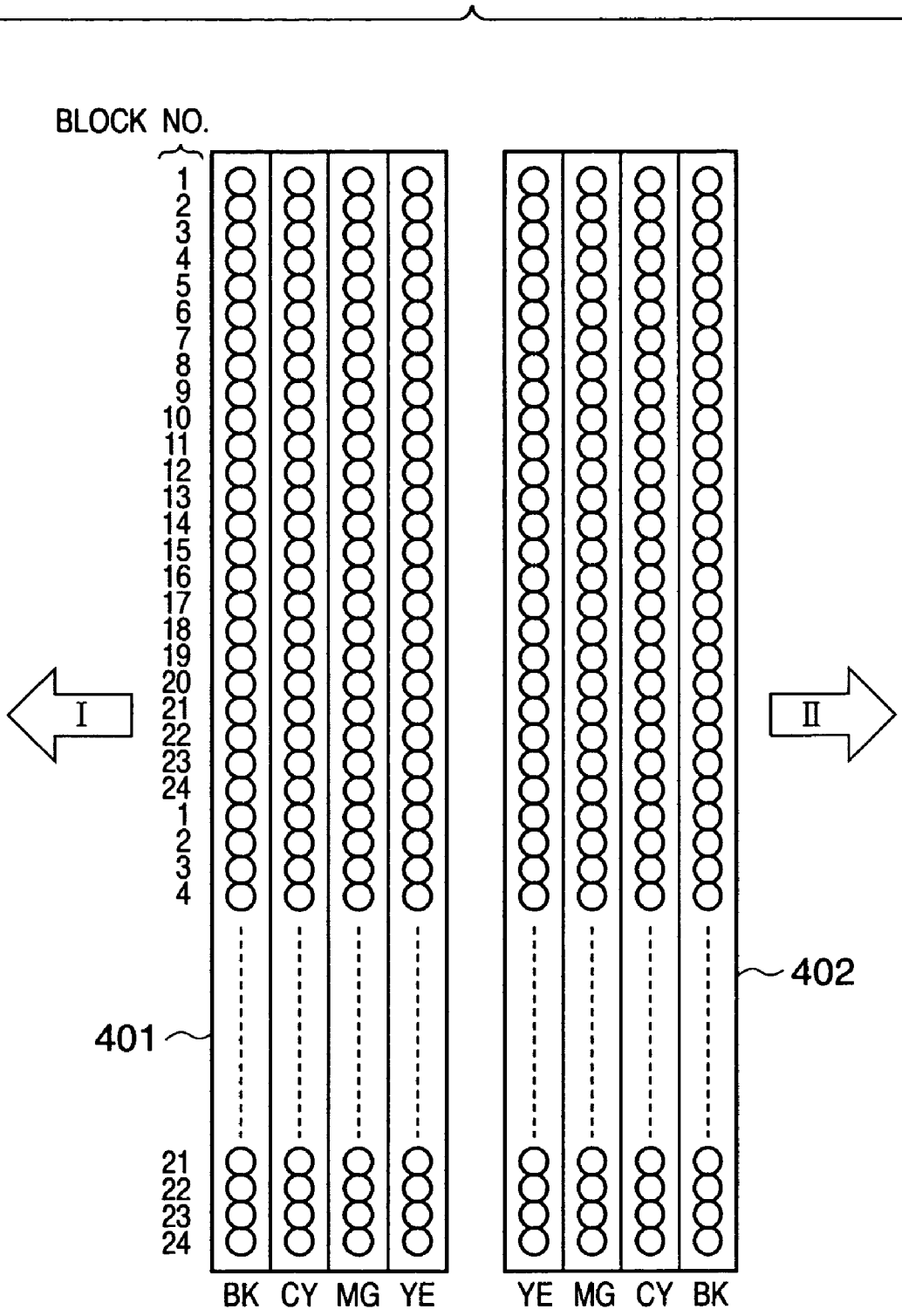
FIG. 8 is a pattern diagram showing correspondence between the printhead's nozzles and block numbers according to the second embodiment of the present invention.

FIG. 8 is a diagram of the first printhead 401 and the second printhead 402 seen from the discharge surface side. Each of the printing element arrays Bk, Cy, Mg and Ye has 1296 discharge orifices (nozzles). Instead of discharging ink droplets simultaneously from all these discharge orifices, the 1296 printing elements are controlled so that they are divided into 24 blocks each including 54 nozzles and sequentially driven in units of block.

The nozzles of one block are distributed equally at intervals of 24 nozzles so that they do not influence each other when ink is discharged. FIG. 8 shows an example of correspondence between the nozzles and block numbers in the printhead according to the second embodiment. More specifically, the printing elements of each printing element array are divided into 24 blocks, and the nozzles of one block are distributed equally at intervals of 24 nozzles as shown in FIG. 8.

Next, driving control of each block is described with reference to FIG. 9.

In the control structure shown in FIG. 9, printing data is temporarily stored in the input/output interface 301 of the printing apparatus, and at the same time, converted to data processable by the printing apparatus and inputted to the CPU 302 which also serves as printhead driving signal supplying means. Based on a control program stored in the ROM 303, the CPU 302 divides the data inputted to the CPU 302 into block units and temporarily stores the divided data in the RAM 304. The data stored in the RAM 304 is again read by the CPU 302 in accordance with the block driving sequence, and transferred from the head driver 307 to the printhead in accordance with the actual discharge timing.

In this stage, the CPU 302 changes the block to be driven for each printhead in accordance with the printhead's scanning direction. To be more specific, in a case where the printhead scans in the forward direction (direction of arrow I in FIG. 8), blocks 1 to 9 are sequentially selected and driven for the first printhead 401 while blocks 10 to 12 are sequentially selected and driven for the second printhead 402. In a case where the printhead scans in the backward direction (direction of arrow II in FIG. 8), blocks 24 to 16 are sequentially selected and driven for the second printhead while blocks 15 to 13 are sequentially selected and driven for the first printhead.

As described above, by selecting the block driving sequence in the control structure of the printing apparatus, it is possible to change the number of blocks driven in each printhead in accordance with the printhead's scanning direction. In the second embodiment, when the printhead scans in the forward direction, it is controlled so that the number of blocks selected in the preceding first printhead 401 is larger than the number of blocks selected in the subsequent second printhead 402, and when the printhead scans in the backward direction, it is controlled so that the number of blocks selected in the preceding second printhead 402 is larger than the number of blocks selected in the subsequent first printhead 401.

As described above, according to the second embodiment, the number of nozzles driven is always larger in the preceding printhead than the subsequent printhead in the scanning direction. As a result, the amount of ink discharged from the preceding printhead, where elapsed time since the last ink discharge is long, is larger than the amount of ink discharged from the subsequent printhead, where elapsed time since the last ink discharge is short. By virtue of this, it is possible to suppress generation of color mixture and bleeding, and improve printing quality.

Note that the ratio of the number of blocks selected in the preceding printhead and the subsequent printhead is not limited to the foregoing example. As long as the number of blocks selected in the preceding printhead is larger than the number of blocks selected in the subsequent printhead, the ratio and the number of blocks selected may be changed appropriately in accordance with the characteristics and discharge condition of the printhead as well as a printing medium.

Although there is no particular limitation as to the combination and sequence of the blocks selected, printing has to be completed by selecting all blocks in two-directional reciprocal scans.

Other Embodiment

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

The present invention can be applied to a system comprising a plurality of devices (e.g., host computer, interface, reader, printer) or to an apparatus comprising a single device (e.g., copying machine, facsimile machine).

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

Examples of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

If the present invention is realized as a storage medium, program codes corresponding to the above mentioned flowcharts (FIG. 6 and FIG. 7) are to be stored in the storage medium.

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Application No. 2003-415419 filed on Dec. 12, 2003, which is hereby incorporated by reference.

What is claimed is:

1. An inkjet printing apparatus for performing printing by using at least two printing element arrays corresponding to inks having a same color, each printing element array having a plurality of printing elements arranged in a predetermined direction, while reciprocally moving the at least two printing element arrays relatively to a printing medium in a moving direction crossing the predetermined direction, comprising:

printing control means which executes a print mode for performing the printing with the at least two printing element arrays in each of reciprocal movements such that, in each of the reciprocal movements, a printing duty of a preceding printing element array which is leading in the moving direction of the at least two printing element arrays is higher than a printing duty of a subsequent printing element array which is trailing in the moving direction of the at least two printing element arrays.

2. The inkjet printing apparatus according to claim 1, wherein said printing control means executes the print mode by switching the printing element arrays of a higher printing duty in a forward movement and a backward movement of the reciprocal movements.

3. The inkjet printing apparatus according to claim 1, wherein a printing unit including the at least two printing element arrays corresponding to the ink of the same color further includes other printing element arrays corresponding to inks of colors different from the color of the inks ejected from the at least two printing element arrays, and the printing element arrays included in the printing unit are symmetrically arranged along the moving direction regarding the same color ink.

4. The inkjet printing apparatus according to claim 1, wherein said printing control means executes the print mode by using mask patterns for distributing printing data to the preceding and subsequent printing element arrays such that the printing duty of the preceding printing element array is higher than the printing duty of the subsequent printing element array in each of the reciprocal movements.

5. The inkjet printing apparatus according to claim 1, wherein said printing control means executes the print mode by dividing each of the preceding and subsequent printing element arrays into a plurality of blocks, and by driving the blocks so that the number of blocks to be driven in the preceding printing element array is greater than the number of blocks to be driven in the subsequent printing element array in each of the reciprocal movements.

6. The inkjet printing apparatus according to claim 1, wherein the print mode is a multi-pass printing mode in which the printing on a same area on the printing medium is completed by repeating the movement plural times.

7. The inkjet printing apparatus according to claim 1, wherein each printing element comprises a heat energy transducer, which generates heat energy for discharging the ink.

8. An inkjet printing method which performs printing with at least two printing element arrays corresponding to inks having a same color, each printing element array having a plurality of printing elements arranged in a predetermined direction, while reciprocally moving the at least two printing element arrays relatively to a printing medium in a moving direction crossing the predetermined direction, comprising:

a step of executing a print mode for performing the printing with the at least two printing element arrays in each of reciprocal movements such that a printing duty of a preceding printing element array which is leading in the moving direction is higher than a printing duty of a subsequent printing element array which is trailing in the moving direction in each of the reciprocal movements.

9. A computer program stored on a computer-readable medium for realizing through a computer a generating method of printing data used in an inkjet printing apparatus, which performs printing with at least two printing element arrays corresponding to inks having a same color, each printing element array having a plurality of printing elements arranged in a predetermined direction, while reciprocally moving the at least two printing element arrays relatively to a printing medium in a moving direction crossing the predetermined direction, comprising:

program codes for a step of generating the printing data to be printed by the at least two printing element arrays in each of reciprocal movements such that an amount of the printing data to be printed by a preceding printing element array which is leading in the moving direction is greater than an amount of the printing data to be printed by a subsequent printing element array which is trailing in the moving direction in each of the reciprocal movements.

10. A storage medium storing a computer program for realizing through a computer a generating method of printing data used in an inkjet printing apparatus, which performs printing with at least two printing element arrays corresponding to inks having a same color, each printing element array having a plurality of printing elements arranged in a predetermined direction, while reciprocally moving the at least two printing element arrays relatively to a printing medium in a moving direction crossing the predetermined direction, comprising:

program codes for a step of generating the printing data to be printed by the at least two printing element arrays in each of reciprocal movements such that an amount of the printing data to be printed by a preceding printing element array which is leading in the moving direction is greater than an amount of the printing data to be printed by a subsequent printing element array which is trailing in the moving direction in each of the reciprocal movements.

11. An inkjet printing apparatus for printing an image on a printing medium by using at least first and second printing element arrays for ejecting an ink of a predetermined color, each printing element array having a plurality of printing elements arranged in a predetermined direction, while reciprocally moving the at least first and second printing element arrays relatively to the printing medium in a moving direction crossing the predetermined direction, comprising:

a generator that generates first printing data to be printed by the first printing element array and second printing data to be printed by the second printing element array for each of reciprocal movements by using mask patterns thinning printing data to be printed in each of the reciprocal movements, the mask patterns including a first mask pattern having a first thinning ratio and a second mask pattern having a second thinning ratio higher than the first thinning ratio; and driving means that drives the printing elements of the first and second printing element arrays based on the first and second printing data generated by said generator, in each of the reciprocal movements including a forward movement and a backward movement, wherein in the forward movement in which the first printing element array becomes a preceding printing element array which is leading in the moving direction and the second printing element array becomes a subsequent printing element array which is trailing in the moving direction, said generator generates the first printing data to be printed by the first printing element array using the first mask pattern and generates the second printing data to be printed by the second printing element array using the second mask pattern, in the backward movement in which the second printing element array becomes the preceding printing element array and the first printing element array becomes the subsequent printing element array, said generator generates the first printing data to be printed by the first printing element array using the second mask pattern and generates the second printing data to be printed by the second printing element array using the first mask pattern, and each of the first and second thinning ratios is higher than 0% and lower than 100%.

12. An inkjet printing method which prints an image on a printing medium with at least first and second printing element arrays for ejecting an ink of a predetermined color, each printing element array having a plurality of printing elements arranged in a predetermined direction, while reciprocally moving the at least first and second printing element arrays relatively to the printing medium in a moving direction crossing the predetermined direction, comprising the steps of:

generating first printing data to be printed by the first printing element array and second printing data to be printed by the second printing element array for each of reciprocal movements by using mask patterns thinning printing data to be printed in the each of the reciprocal movements, the mask patterns including a first mask pattern having a first thinning ratio and a second mask pattern having a second thinning ratio higher than the first thinning ratio; and driving the printing elements of the first and second printing element arrays based on the first and second printing data generated in said generating step, in each of reciprocal movements including a forward movement and a backward movement, wherein in the forward movement in which the first printing element array becomes a preceding printing element array which is leading in the moving direction and the second printing element array becomes a subsequent printing element array which is trailing in the moving direction, the first mask pattern is used to generate the first printing data to be printed by the first printing element array and the second mask pattern is used to generate the second printing data to be printed by the second printing element array, in the backward movement in which the second printing element array becomes the preceding printing element array and the first printing element array becomes the subsequent printing element array, the second mask pattern is used to generate the first printing data to be printed by the first printing element array and the first mask pattern is used to generate the second printing data to be printed by the second printing element array, and each of the first and second thinning ratios is higher than 0% and lower than 100%.

* * * * *